US006035439A

United States Patent [19]

Chin

[11] Patent Number: 6,035,439

[45] Date of Patent: Mar. 14, 2000

[54] WHOLLY AND PARTIALLY REMOVABLE GARMENT

[76] Inventor: May Ying Chin, 22 Indian Springs Way, Wellesley, Mass. 02181

[21] Appl. No.: 08/884,456

[22] Filed: Jun. 27, 1997

Related U.S. Application Data

[63] Continuation-in-part of application No. 08/724,965, Oct. 3, 1996, abandoned, which is a continuation of application No. 08/322,694, Oct. 13, 1994, abandoned.

[51] Int. Cl.[7] ..... A41D 5/00; A41B 9/00; A41B 9/04

[52] U.S. Cl. ..... 2/67; 2/78.2; 2/408

[58] Field of Search ..... 2/67, 78.2, 80, 2/408, 401; 450/95, 115, 132, 133, 155

[56] References Cited

U.S. PATENT DOCUMENTS

| | | | |
|---|---|---|---|
| D. 138,422 | 8/1944 | Mitchell | D3/17 |
| D. 239,667 | 4/1976 | Bouchard | D2/2 |
| D. 249,096 | 8/1978 | Fowler | D2/40 |
| 1,092,696 | 4/1914 | Curry . | |
| 1,954,526 | 4/1934 | Holohan . | |
| 2,016,664 | 10/1935 | Brewster | 2/112 |
| 2,060,689 | 11/1936 | Read | 2/67 |
| 2,335,658 | 11/1943 | Fishbein | 2/67 |
| 2,355,404 | 8/1944 | Virden et al. | 2/67 |
| 2,390,462 | 12/1945 | Rosenberg | 2/70 |
| 2,412,502 | 12/1946 | Garrison | 2/67 |
| 2,561,783 | 7/1951 | Burr | 2/78 |
| 2,567,442 | 9/1951 | Mitchell | 2/67 |
| 2,857,600 | 10/1958 | Finn | 2/67 |
| 3,036,574 | 5/1962 | Jeffrey | 2/67 X |
| 4,656,669 | 4/1987 | Beard | 2/67 |
| 4,694,511 | 9/1987 | Estes et al. | 2/67 X |
| 5,083,316 | 1/1992 | Kuehner | 2/67 |
| 5,561,858 | 10/1996 | Poirier | 2/408 X |

OTHER PUBLICATIONS

Jul. 1994 Women's Wear Daily, Photographs of bathing suits.

Copy of Summer 1995 Sale Catalog for the Right Start Catalog, p. 51, reference J: item #E293, entitled "Girl's Swim Diaperwear" [sic].

Packaging Information from a Girl's Tank Swimsuit marketed by Diaperwhere, Inc., purchased at the Right Start Store, Natick, MA, Aug. 1995.

*Primary Examiner*—John J. Calvert
*Assistant Examiner*—Shirra L. Jenkins
*Attorney, Agent, or Firm*—Maura K. Moran

[57] ABSTRACT

A unitary garment for full or partial coverage of a torso that may be fully put on or removed, at the choice of the wearer, as an assembled or a disassembled garment, and subsequently may be partially removed and put on, again at the choice of the wearer, has a torso portion for providing at least some coverage of the front and back of a wearer, a pants portion having a front portion, a crotch portion for passing between the legs and connected to the front portion, and a seat portion connected to the crotch portion. One of the seat portion and front portion is connected to the torso portion, and the other of the front portion and seat portion has at its edges first fastening elements to selectively attach and release to assemble and disassemble the garment. In another aspect of the invention, a unitary garment for full or partial coverage of a torso has a pants portion, for providing at least some coverage of the bottom half of a wearer, and a torso portion, for providing at least some coverage of the front and back of the top half of a wearer. One of the pants and the torso portions has an over band forming an inwardly facing ridge, the other of the portions has an under band forming an outwardly facing ridge, so that, when the one portion is disposed over the other portion, the bands interlock. Thus, the outwardly facing ridge is disposed between the inwardly facing ridge and the one portion, and the inwardly facing ridge is disposed between the outwardly facing ridge and the other piece to releasably attach the pants portion to the torso portion.

35 Claims, 9 Drawing Sheets

WHOLLY AND PARTIALLY REMOVABLE GARMENT

This application is a file-wrapper continuation-in-part of application Ser. No. 08/724,965, filed Oct. 3 1996, now abandoned which is a file wrapper continuation of application Ser. No. 322,694 filed on Oct. 13 1994, now abandoned.

BACKGROUND OF THE INVENTION

This invention relates generally to clothing and particularly to unitary garments designed for full or partial coverage of the torso.

Unitary garments such as women's bathing suits, exercise suits, and leotards, are popular because of their ease of wear and use, and for other reasons of style. They are often made of knit and elastic materials and are tight fitting. As a result, they can be difficult to put on and take off, especially when wet. In addition, every visit that a wearer makes to the bathroom requires a complete removal of the outfit, and subsequent re-dressing. This problem becomes more annoying when the outfit is worn, alone or under other clothing, for long periods of time or even all day, as happens frequently given the multiple, simultaneous uses to which such unitary garments are put by today's wearers. Such uses include cross-training training (biking/hiking/swimming workouts) and all-day outings. A wearer does not want to keep getting dressed and re-dressed all day. Further, the changing and bathroom facilities in exercise-oriented venues, such as state parks and beaches, often are not sanitary, convenient or available. One solution that women have adopted has been to wear two piece outfits. However, by their nature, two piece outfits do not provide the full torso coverage and sleek, utilitarian lines of a one-piece garment.

Unitary garments are also useful in infant's and small children's clothing, where full torso coverage is preferred. Unfortunately, diapering and frequent bathroom visits, necessities with small children, are rendered difficult with unitary garments. Many one piece children's outfits have snaps at the crotch. However, snaps can be difficult to attach when the child is squirming. Also, snaps are rarely, if ever, found on an infant's or child's bathing suit.

One-piece bathing suits having removable portions to facilitate dressing and bathroom visits are well known in the prior art. However, none of the designs teach truly convenient or inconspicuous fastening mechanisms. For example, U.S. Pat. No. 5,083,316 (1992) to Ellen M. Kuehner, entitled Garment Structure, provides a decorative, interchangeable, removable crotch piece to effect ornamental definition while facilitating bodily functions. While the garment taught by Kuehner provides the sleek, stylish look of a unitary garment, it provides the attachment of the crotch piece at the pelvic bone, where attachment is somewhat inconvenient. Further, the garment described by Kuehner does not attempt to conceal the area of crotch access.

U.S. Pat. No. 2,857,600 (1958) to Gerald C. Finn, entitled Women's Bathing Suit, provides for concealed, releasable attachment of a crotch piece, inconveniently, again, at the pelvic bone at the front of a bathing suit. Finally, Finn also teaches auxiliary detachable securing of the crotch piece to the skirt or to an elongated restraining girdle band inside the front of the suit. These features render the garment design complicated, expensive to manufacture, and uncomfortable to wear.

One-piece suits consisting of a torso portion and a seat portion wrappable between the legs and fastenable about the body have been suggested, but none have taught both convenient and inconspicuous fastening mechanisms. U.S. Pat. No. 1,954,526 (1934) to E. Holahan, entitled Bathing Outfit, shows a suit consisting of a torso portion and a seat portion wrappable between the legs and held together at the hips with buttons and snaps and at the waist by a somewhat complicated arrangement. Side straps button at the waist in the back of the suit; then an extension of the seat portion, passed under the buttoned side straps, is buttoned onto the side straps; and, finally, the shoulder straps button over the seat extension onto the side straps. U.S. Pat. No. 2,060,689 (1936) to D. Read, entitled Bathing Suit, shows a wrap suit which uses front and back waist hook and eye closures. In use, a wearer wraps the suit between the legs, and hooks the seat portion to itself in the front under the suit (an awkward hand action), and then hooks tapered lateral projections in the back at the waist. It could not be completely assembled and subsequently put on and removed as a conventional unitary garment.

A number of wrap suits attach by ties. U.S. Pat. No. 2,567,442 (1951) to Alex Mitchell, entitled Bathing Garment, shows a suit secured to the body by ties at the neck, sides and waist. Ties also attach bathing suits in Design Pat. Nos. 138,422 (1944) (also to Alex Mitchell), 239,667 (1976) (to Eleanor Bouchard), and 249,096 (1978) (to Catalina Fowler). U.S. Pat. No. 2,412,502 (1946) to Bertice Garrison shows play suits that attach in the front and back with ties. Ties, while relatively simple and secure during sedentary use or light exercise, are lumpy to lie on, often require fussing to make them look right, occasionally tickle, and, during periods of heavy exercise, can come undone. Further, the bulkiness of knots take away from the sleek lines of a one-piece garment.

U.S. Pat. No. 2,561,783 (1951) to Marian Burr, is an undergarment (not intended for outerwear) designed for great snugness of fit and having a seat portion wrappable between the legs and fastenable with small hooks and eyes about the body to provide "give" in stress spots in a very tight-fitting garment. The garment is shown to have a complicated and expensive manufacture, being made of many pieces of fabric, some of which are cut straight with the cloth and others are cut on the bias to provide differential areas of support and stretch. Not intended to be made in today's active-wear materials, it could not be put on and removed as a conventional unitary garment.

Some designs suggest solving the above-described problems by creating a one-piece suit out of a two piece suit. U.S. Pat. No. 5,083,316 (1992), mentioned above, and U.S. Pat. No. 4,656,669 (1987) to Donna Beard, entitled Versatile Bathing Suit, both show a conventional two piece bathing suit apparently changed into a one piece suit by fastening an additional band of material onto the bra and panties of the two piece suit.

None of the above designs teach truly convenient, strong, secure, and inconspicuous fastening mechanisms.

It is an object of the invention to provide a garment with easy inconspicuous access to the crotch area while retaining the sleek, stylish look and easy functionality and operability of a one-piece garment.

It is a further object of the invention to provide a garment that is convenient and secure to wear, and easy and inexpensive to manufacture.

It is a further object of the invention to provide an infant and children's garment that is convenient to put on and remove.

It is a further object of the invention to provide a unitary garment arranged to be put on and removed, at the choice of the wearer, as an assembled or disassembled garment.

SUMMARY OF THE INVENTION

These and further objects are achieved by providing a unitary garment for full or partial coverage of a torso that may be fully put on or removed, at the choice of the wearer, as an assembled or a disassembled garment, and subsequently may be partially removed and put on, again at the choice of the wearer. The garment comprises a torso portion for providing at least some coverage of the front and back of a wearer, a pants portion having a front portion, a crotch portion for passing between the legs and connected to the front portion, and a seat portion connected to the crotch portion. One of the seat portion and front portion is connected to the torso portion, and the other of the front portion and seat portion has at its edges first fastening elements to selectively attach and release to assemble and disassemble the garment.

In one embodiment, the other portion selectively attaches to itself when it is wrapped between the legs and over the one portion, and the first fastening elements connect to themselves. In addition, the fastening elements, which may velcro be fasteners or the parts of a zipper, connect to form a panel, which may be a reinforcing panel or an elasticized stomach muscle control panel. In another embodiment, the seat portion releasably attaches to the front portion. The one portion has second fastening elements, near the connection of the torso portion and pants portion, to selectively attach and release from the first fastening elements on the other portion.

In one embodiment, the seat portion is connected to the torso portion, so the pants portion wraps from back to front. In another embodiment, the front portion is connected to the torso portion, so the pants portion wraps from front to back. In whatever direction the wrap occurs, the torso portion may have sufficient length or a shirt-tail at its bottom edge portion to be disposed underneath the pants portion for full bodily coverage.

The fastening elements may be located at about the hips of the unitary garment or may be positioned to attach the pants portion at about the waist of the wearer. They may be bra hook and loop combinations, ring and loop combinations, or clasps. In addition, when connected, they may be held in tension toward each other to cause the forward edge of the seat portion to be pressed against the skin of a wearer and thus held tight against the wearer.

In other embodiments, the fastening elements are hidden by a full or partial skirt extending from the torso portion, or by at least part of a waist band portion extending at least part of the way around the waist of the unitary garment. In yet another embodiment, the torso portion is provided with a releasably attachable top torso portion, so that the unitary garment may be put on and removed under a wearer's clothing.

In a further embodiment, the unitary garment is provided with an attachment system comprising a connection element attached to the pants portion and to which the sets of fastening elements are attached when the garment is assembled. The connection element provides a tension between the pants fasteners and toward each other when formed. The front portion may function as the connecting portion, and the seat portion may function as the selective attachment portion. The connection element may be a reinforcing panel such as an elasticized stomach muscle control panel, or an elasticized strip of material extending across the connecting portion, with one part of the pants fasteners being loops at each end of the strip. The connection element may be sized such that, when the pants fasteners are attached, the circumference formed by the garment is slightly smaller than the circumference of the wearer.

In other embodiments, there is described an attachment system for a unitary garment having a torso portion, a pants portion that passes between the legs and connects to form the garment, the pants portion with a seat portion and a front portion. The attachment system comprises pants fasteners and means to provide longitudinal tension between the pants fasteners and toward each other when the pants fasteners are attached. The attachment system may also comprise pants fasteners and means to reduce the circumference of the garment, when the pants fasteners are attached, to be slightly smaller than the circumference of the wearer.

In accordance with a further aspect of the invention, a unitary garment for full or partial coverage of a torso has a pants portion, for providing at least some coverage of the bottom half of a wearer, and a torso portion, for providing at least some coverage of the front and back of the top half of a wearer. One of the pants and the torso portions has an over band forming an inwardly facing ridge, the other of the portions has an under band forming an outwardly facing ridge, so that, when the one portion is disposed over the other portion, the bands interlock. Thus, the outwardly facing ridge is disposed between the inwardly facing ridge and the one portion, and the inwardly facing ridge is disposed between the outwardly facing ridge and the other piece to releasably attach the pants portion to the torso portion.

In one embodiment, the one portion is the pants portion, with the over band being a pants band forming a downwardly and inwardly facing ridge. The other portion is the torso portion having a torso edge portion for disposition within the pants portion. The under band is a torso band, disposed on the edge portion, forming an upwardly and outwardly facing ridge. When the torso portion is tucked into the pants portion, the bands interlock to releasably attach the pants portion to the torso portion.

In another embodiment, the one portion is the torso portion, with the over band being a torso band forming an upwardly and inwardly facing ridge. The other portion is the pants portion arranged for disposition under the torso portion. The under band is a pants band, forming a downwardly and outwardly facing ridge. When the pants portion is disposed under the torso portion, the bands interlock to releasably attach the pants portion to the torso portion.

The bands may be positioned to be disposed about the waist, hips, or chest of a wearer of the garment. They may be formed of a rigid or semi-rigid material or of elastic. At least one of them may have a selectively sized circumference, to be changed by the wearer. In yet further embodiments, the garment is formed of material that stretches in at least two different directions.

BRIEF DESCRIPTION OF THE DRAWINGS

The above-mentioned and other features of the invention will become more apparent by reference to the following description taken in connection with the accompanying drawings in which.

DESCRIPTION OF THE PREFERRED EMBODIMENTS

Figure 1A:
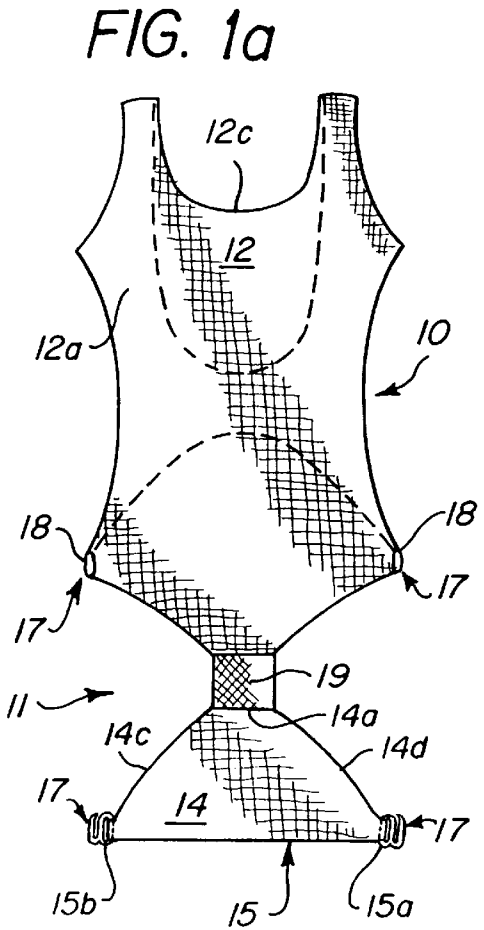
FIG. 1*a* is a front perspective view of a first embodiment of the present invention, showing a disassembled suit.

FIG. 1*a* shows the front of a bathing suit 10 having a torso portion 12 and a seat portion 14. The rear of the suit 10 may be seen as a dashed line in FIG. 1*a*., and the front of the suit 10 may be seen as a dashed line in FIG. 1*b*. The suit 10 is shown disassembled, as in prior to use, with the pants portion 11, when secured in place, serving to define a bathing suit's usual leg openings and seat in the bottom of the suit 10. The suit 10 is formed from a few simple separate pieces of material, providing economy of pattern layout and easy manufacturing. For example, the suit 10 may be made of three pieces of material, a front torso portion 12*a*, a rear torso portion 12*b*, and a seat portion 14, cut straight on a length of material having a horizontal, or width-wise stretch, so that the suit, when sewn together to form the suit 10, will have stretch in at least the horizontal direction and thus allow it to be form fitting and put on over the hips or shoulders. As seen in FIG. 1*a*, the suit 10 may also have a crotch piece 19 made of cotton or other breathable material, or a breathable liner, not shown, added to increase the comfort of the wearer. The seat portion 14 has a crotch edge 14*a* connected to the crotch piece 19, two sides 14*c*, 14*d* extending therefrom, and a forward edge 15 opposite the crotch piece 19 . The edge 15 has left end 15*a* and right end 15*b* at the junction of it and the two sides 14*c*, 14*d*. The rest of the suit 10 may be made of cotton or of nylon Lycra fabric, a material frequently used in bathing suits for its ease of drying and its stretchiness.

Figure 1B:
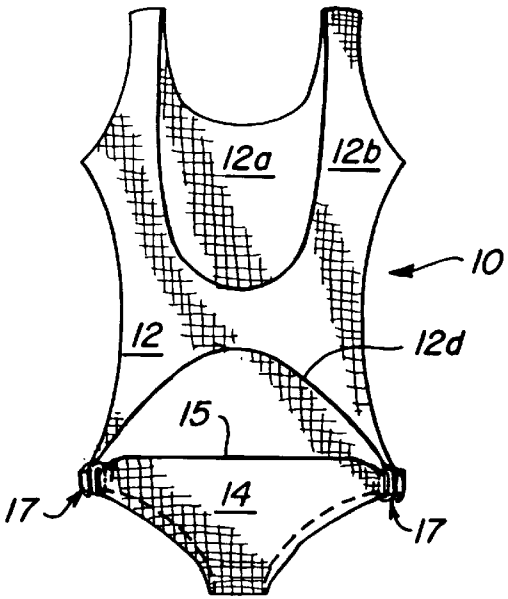
FIG. 1*b* is a rear perspective view of the embodiment of FIG. 1*a*, showing the suit as in use with the seat portion wrapped from front to back between the legs and attached to the torso portion at the hips.

The left and right hips of the torso portion 12 and the left and right ends, or corners, of the forward edge 15 of the seat portion 14 are provided with a single set of fastening elements 17. As seen in FIGS. 1*a* and 1*b*, the set of fastening elements 17 are sewn onto the suit 10 at locations that will be visible to a wearer of the suit 10, with a first of the fastening elements 17 in the set being sewn onto the seat portion 14, and a second of the elements in the set being sewn onto the torso portion 12. The fastening elements 17 may be any kind of fasteners, including but not limited to hook and pile means, commonly known as "VELCRO", available from VELCRO USA INC., of Manchester, N.H., or any kind of clasps or buckles. In the current embodiment, the elements 17 are swim bra hooks 16, shown in FIG. 1*c* as having a geometry that is essentially coplanar to the seat portion 14 sewn onto the ends of the top edge 15 of the seat portion 14, and loops 18, located on the hips of torso portion 12. Each hook 16 has a slot 13 for receiving an edge of material to create a self loop from the material when it is drawn through the slot 13, lapped over and sewn down. The hooks 16 used in the current embodiment are Swim Suit Bra Hooks (¾ inch size) available from Dritz Corporation of Spartansburg, S.C.

Figure 1C:
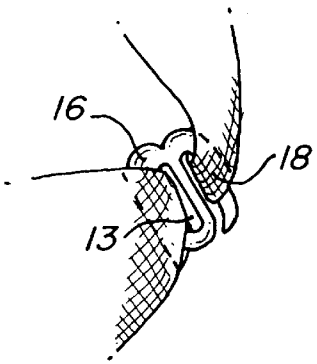
FIG. 1*c* is an enlarged view of the locking mechanism shown in FIG. 1.
Figure 1D:
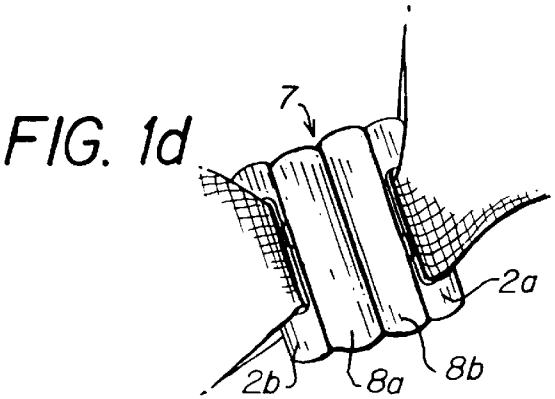
FIG. 1*d* is an enlarged view of an alternative locking mechanism for the embodiment shown in FIG. 1.
Figure 1E:
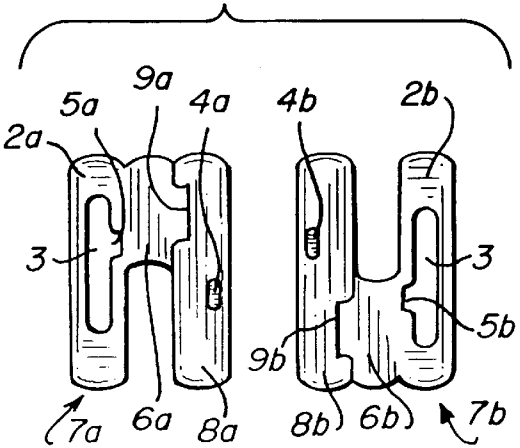
FIG. 1*e* is an enlarged view of the locking mechanism shown in FIG. 1*d*, now shown disassembled.

In other embodiments, it may be preferable to provide a cooperative clasp combination of the sort shown in FIG. 1*d* and 1*e*. The clasp 7, being 2¼" in height and 1½" in length, is a very flat, very secure clasp formed of two parts, a right member 7*a* and a left member 7*b*, each with a flat edge portion 2*a*, 2*b* having a slot 3, for receiving an edge of material and creating a self loop, and a flat receiving portion 6*a*, 6*b* that is essentially planar with the flat edge portion 2*a*, 2*b*. Each member 7*a*, 7*b* also has a flat raised portion 8*a*, 8*b* in a plane parallel to but above the plane containing the portions 2*a*, 2*b*, 6*a*, and 6*b*. The offset between the planes is essentially the thickness of the portions 8*a* and 8*b*. The portion 6*a* extends across the upper half of the member 7*a*, and the portion 6*b* extends across the lower half of the member 7*b*. At the juncture between the portions 6*a*, 6*b* and 8*a*, 8*b* are the ridges 9*a*, 9*b*, planar with portions 6*a*, 6*b*. Each slot 3 has an indentation 5*a*, 5*b* and each raised portion 8*a*, 8*b* has a bar 4*a*, 4*b* extending downwardly therefrom, with the bar 4*a*, 4*b* arranged to fit into the indentation 5*b*, 5*a* respectively when the clasp 7 is closed. The flat receiving portions 6*a*, 6*b* are sized and arranged to receive and hold the raised portions 8*b*, 8*a*. When the portions 8*b*, 8*a*, slip into the receiving portions 6*a*, 6*b*, the ridges 9*a*, 9*b*, operate as a hinge to facilitate the clipping together of the portions 6*a*, 6*b*, 8*a*, 8*b*, with the bar 4*a*, 4*b* locking the clasp 7 by slipping into the indentation 5*b*, 5*a* respectively. The clasp 7 is available from Windsor Button Shop, of Newton, Mass. as Part No. R876.

In other embodiments, it may be preferable to provide even larger hooks, for easier clasping and aesthetic reasons. The fastening elements may be smaller in size or different in design. For example, a circle or ring having an gap or a latch to receive a loop, or a sealed circle or ring to receive a loop releasable with VELCRO fasteners, might be attractive.

The invention in operation is shown in FIGS. 1*b* and 1*c*. In use, the suit 10 may be put on in two different ways. A user may join the hooks 16 and loops 18, thus attaching the seat portion 14 to the torso portion 12 at the hips to secure the pants portion 11 to completely form the suit 10, and then put on the suit 10 like a regular tank-style bathing suit, legs first. Given that the material with which the suit 10 is made can stretch in at least the width-wise direction, the suit 10 may be slipped up and over the hips and fit snugly about the body of the wearer. Alternatively, the user could slip the suit on over her head, then wrap the seat portion 14 between her legs from front to back, and attach the torso portion 12 to seat portion 14 by slipping the hooks 16 into the loops 18. During a visit to the bathroom, a user may completely undress, or she may unhook the hooks 16 from the loops 18 and unwrap the seat portion 14 from back to front. For convenience, when using the toilet, the wearer who has partially removed the suit 10 may hang the seat portion 14 from the front neck opening 12*c* of the torso portion 12. After the bathroom visit, the user simply re-wraps the seat portion 14 between the legs from front to back, and re-attaches the hooks 16 into the loops 18. Also, the hooks 16 may be released momentarily in the ocean to dislodge sand from the pants portion 11.

Figure 2C:
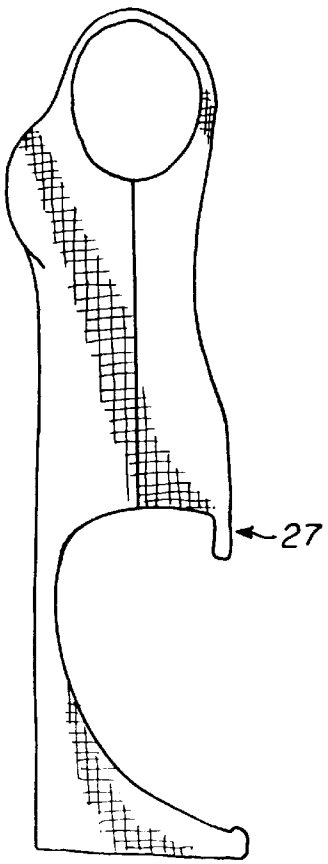
FIG. 2*c* is a side perspective view of another embodiment, also showing the suit disassembled.
Figure 2B:
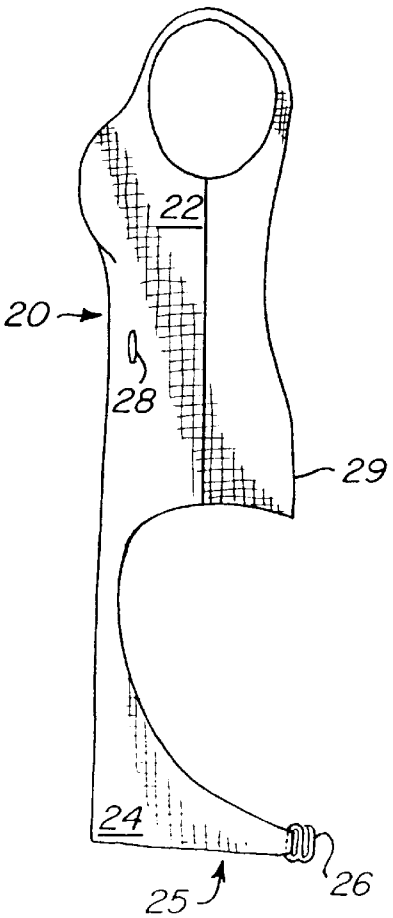
FIG. 2*b* is a side perspective view of the embodiment of FIG. 2*a*, showing the suit disassembled.
Figure 2A:
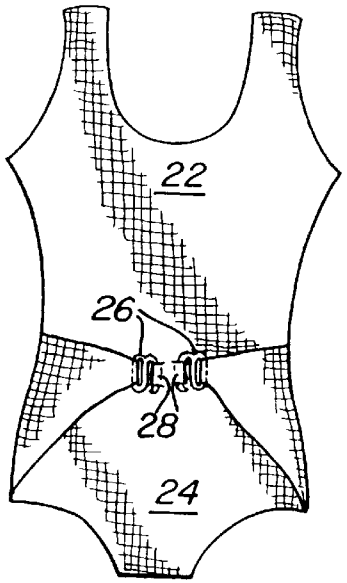
FIG. 2*a* is a front perspective view of a second embodiment, showing the seat portion wrappable from front to back and attached to the torso portion at the waist.
Figure 3B:
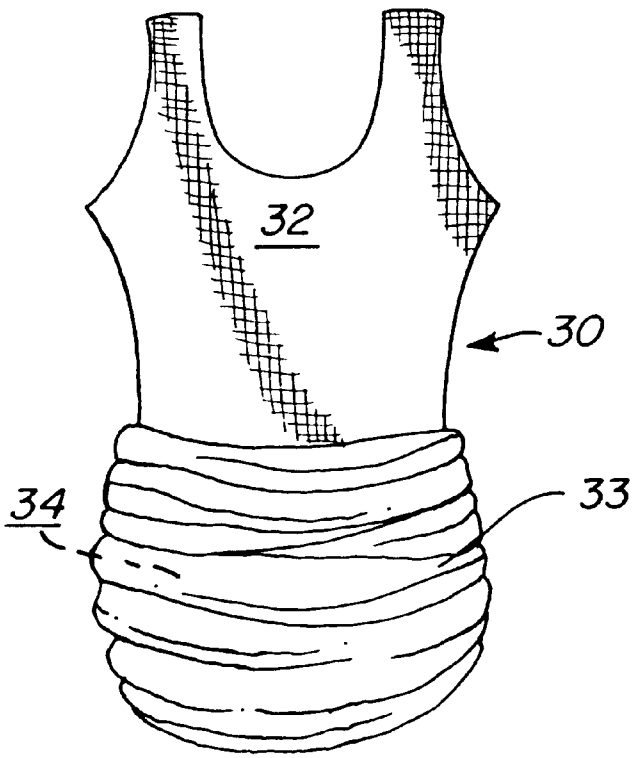
FIG. 3*b* is a rear perspective view of the embodiment of FIG. 3*a;*
Figure 3A:
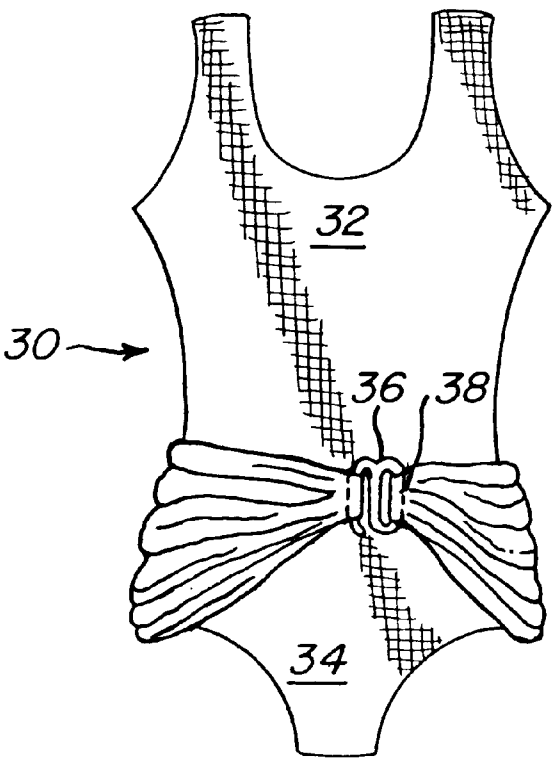
FIG. 3*a* is a front perspective view of a third embodiment, showing a shirred seat portion wrappable from front to back between the legs and attached to itself at the waist.

FIGS. 2*a* and 2*b* show a second embodiment of the invention, in which a suit 20 has a torso portion 22, with loops 28 sewn onto the exterior of the torso portion 22 at the waist, and a seat portion 24, with hooks 26 on the left and right ends of the forward edge 25 of the seat portion 24. The suit 20 is formed into a unitary garment, with attachments on the exterior of the garment, by wrapping the seat portion 24 between a person's legs from front to back and releasably attaching the hooks 26 into loops 28. FIG. 2*b* shows the torso portion 22 provided with a deep tank top bottom portion 29 arranged to cover at least a portion of a wearer's hips. In use, the tank top bottom portion 29 lies underneath the seat portion 24 so as to ensure complete coverage of a user's back. In lieu of a tank top bottom portion 29, the suit 20 may have a deep rectangular shaped shirt-tail, 27, shown in FIG. 2*c*, for tucking into the seat portion 24. FIGS. 3*a* and 3*b* show a third embodiment of the invention, in which a suit 30 has a torso portion 32 and a seat portion 34, with a hook 36 and a loop 38 sewn into the left and right ends of the forward edge 35 of the seat portion 34. The unitary garment is again formed by wrapping the seat portion 34 between a person's legs from front to back. In the current embodiment, however, the seat portion 34 releasably attaches to itself (using the hook 36 and the loop 38) and not to the torso portion 32. Again, the torso portion 32 is provided with a deep tank top bottom portion, not shown, in the back of the suit 30 which, in use, lies underneath the seat portion 34 so as to ensure complete coverage of a user's back. The suit 30 is shown having optional shirring in the seat portion 34. It may also be desirable to have seat portion made of material of contrasting color.

Figure 15:
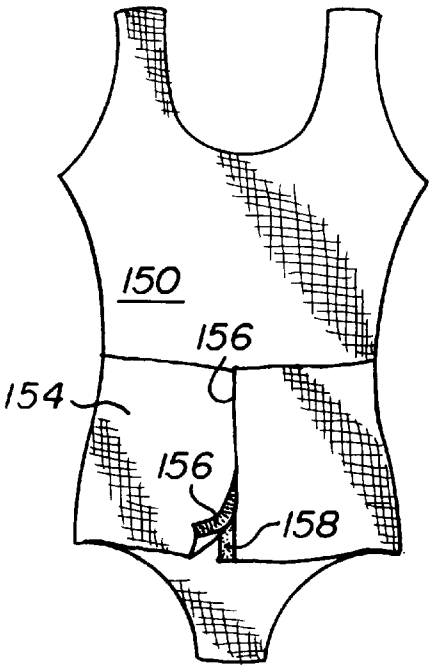
FIG. 15 is a front perspective view of a twelfth embodiment, showing a seat portion attached to itself by Velcro fastener closures.
Figure 14:
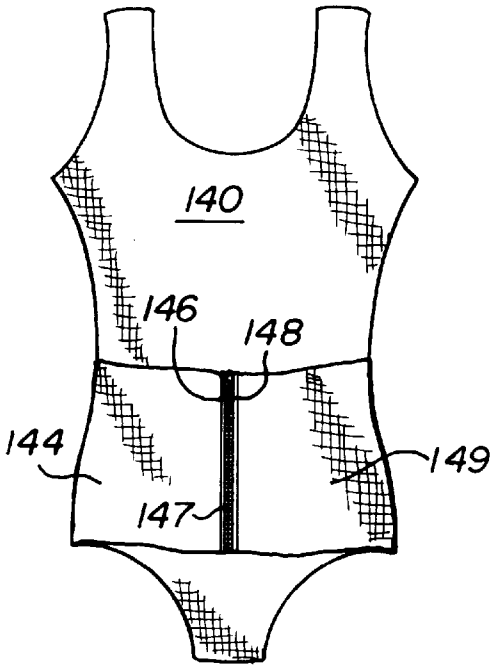
FIG. 14 is a front perspective view of a twelfth embodiment, showing a seat portion wrappable from front to back between the legs and attached to itself at the waist by a zipper to form a reinforcing stomach control panel.

FIG. 14 shows another garment 140 with a seat portion 144 wrappable from front to back between the legs and attached to itself. The garment 140 has a seat portion 144, with edges 146, 148 of a zipper 147 located along at least a portion of the left and right sides of the seat portion 144. When the zipper 147 is attached, the seat portion forms a panel, which may be a reinforcing panel 149. The panel 149 may also be elasticized to provide stomach muscle control. FIG. 15 shows another garment 150 with a seat portion 154 connected by V▭v]Velcro fastener edges 156, 158.

Figure 4C:
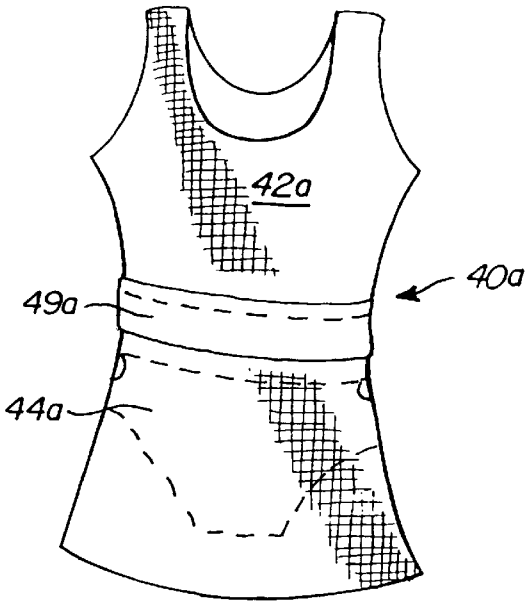
FIG. 4*c* is a front perspective view of another embodiment, showing a minidress having a waistband and a pants portion shown with a dashed line.
Figure 4B:
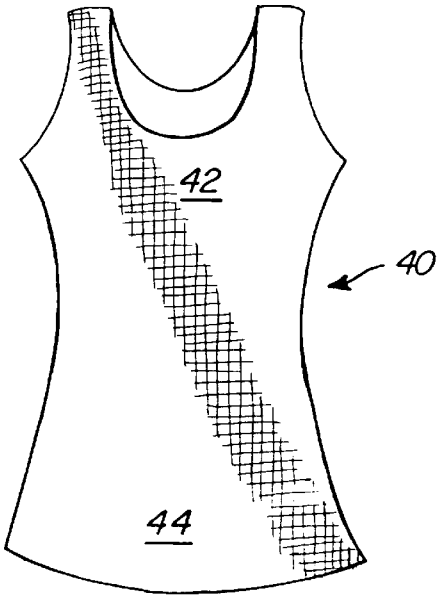
FIG. 4*b* is a rear perspective view of the embodiment of FIG. 4*a*, showing the suit assembled.
Figure 4A:
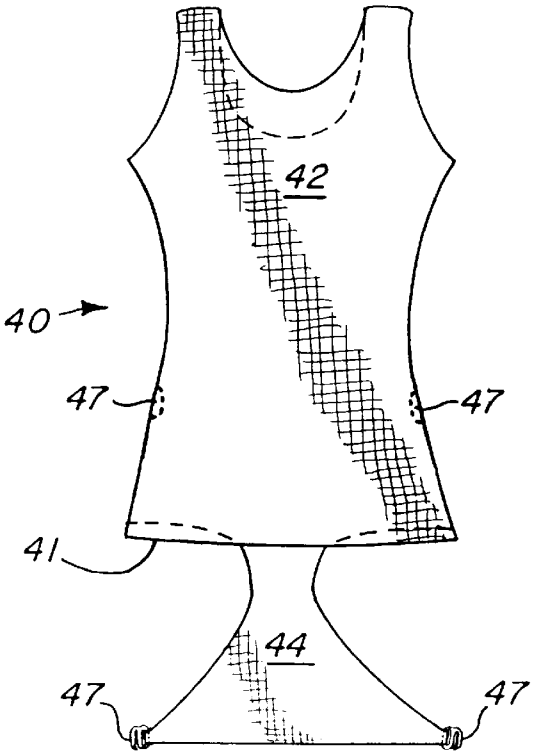
FIG. 4*a* is a front perspective view of a fourth embodiment, showing a disassembled suit having a seat portion wrappable from back to front and attachable to the torso portion at the hips.

FIGS. 4*a* and 4*b* show a fourth embodiment of the invention, in which a suit 40 is formed into a unitary garment by wrapping a pants portion 44 between a person's legs from back to front and releasably attaching the pants portion 44 to the torso portion 42 using fastening elements 47 under a short skirt 41 located in the front of the torso portion 42. The skirt 41, found only on the front of the suit 40, is an extension of the torso portion 42, similar to a long tank top extending at least partially over a wearer's hips. The fastening elements 47 are sewn onto the edges of the pants portion 44, and on the inside of the suit 40 at its side seams, not shown, between the hips and the waist. Further, as shown in FIG. 4*b*, the rear of the suit has no ornamentation, and so appears to be in the style of a conventional simple tank-style bathing suit. Alternatively, the skirt 41 may be an extra piece of material, gathered or flared, sewn all the way around the front and back of the torso portion 42. A belt or waist band portion, not shown, might be provided to camouflage the stitching that joins the skirt 41 to the suit 40. Alternatively, the suit 40*a* may be designed as shown in FIG. 4*c* to have its torso portion 42*a* long enough to constitute a minidress and its pants portion 44*a* sewn onto the torso portion 42*a* on the inside of the front of the torso portion 42*a*, so that the pants portion 44*a* wraps between the legs from front to back and attaches to itself at the hips. A belt or waist band portion 49*a* may be provided to camouflage the stitching that joins the pants portion 44*a* to the suit 40*a*.

Figure 5A:
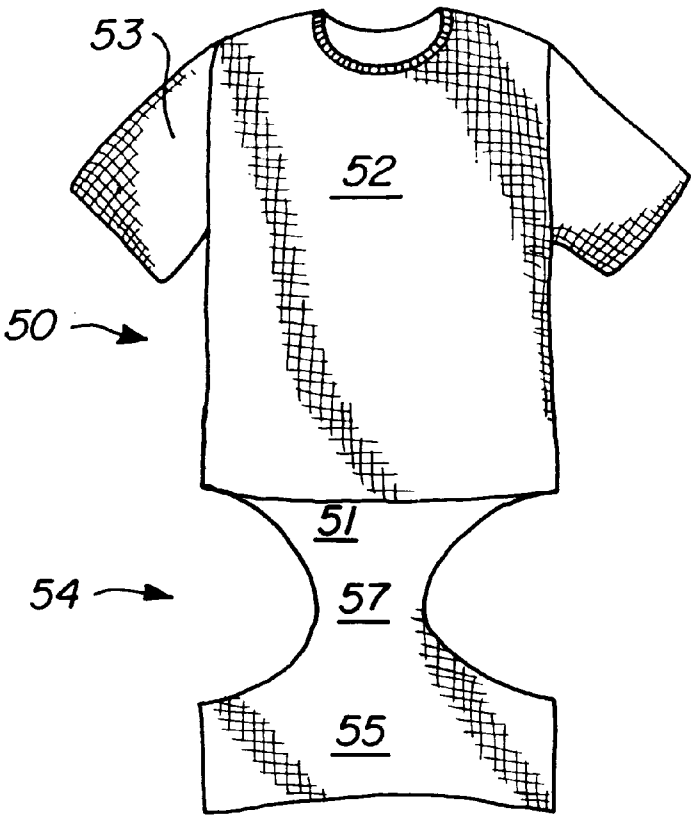
FIG. 5*a* is a front perspective view of the fifth embodiment, showing the children's suit disassembled and without fastening elements.
Figure 5:
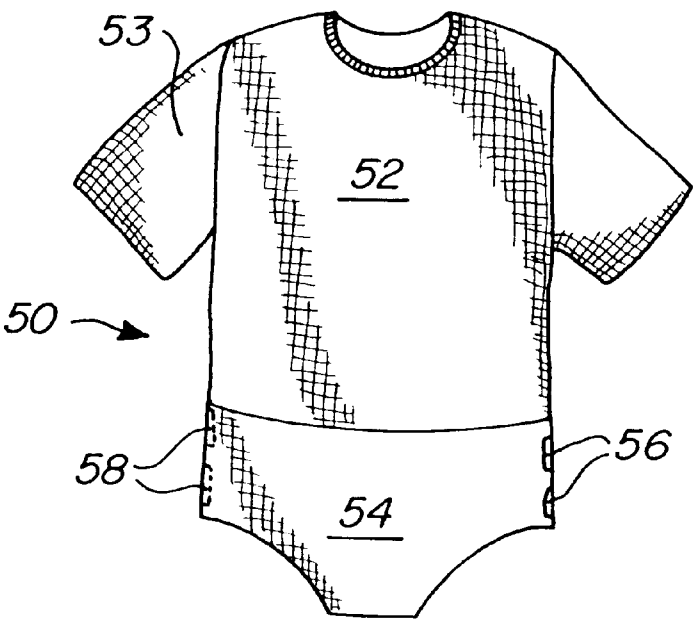
FIG. 5 is a front perspective view of a fifth embodiment, showing a children's suit.

The style of the torso of the above-described suits may vary greatly. For example, the top portion of the torso portion may have different armhole cuts and neck closures. A suit may be strapless, or have thin straps or sleeves. For example, FIGS. 5 AND 5*a* show a child's outfit, particularly adapted for ease of diapering, in which a suit 50, having sleeves 53 attached to a torso portion 52, has pants portion 54 with a front portion 55, a crotch portion 57 for passing between the legs and connected to the front portion 55, and a seat portion 51 connected to the crotch portion 57 and the torso portion 52. The suit 50 is formed into a unitary garment by wrapping the pants portion 54 between a child's legs from back to front and releasably attaching the pants portion 54 to the torso portion 52 using two pairs of hooks 56 and loops 58 at the waist and hips of the suit 50. A full or partial belt or band of decorative material, not shown, may be provided to conceal some or all of the hooking mechanism.

Figure 7:
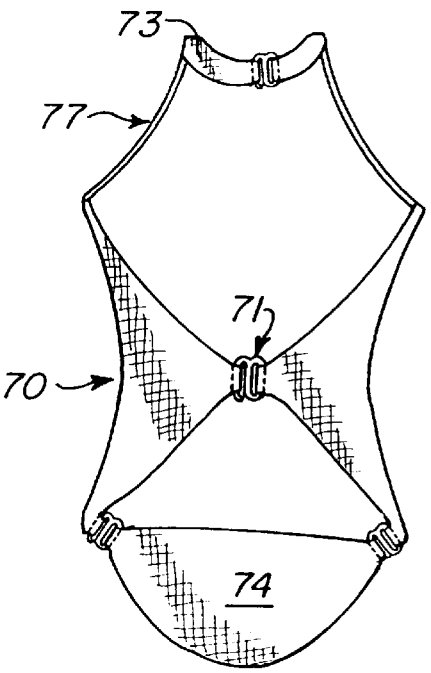
FIG. 7 is a rear perspective view of a seventh embodiment, showing an alternative torso portion.
Figure 6:
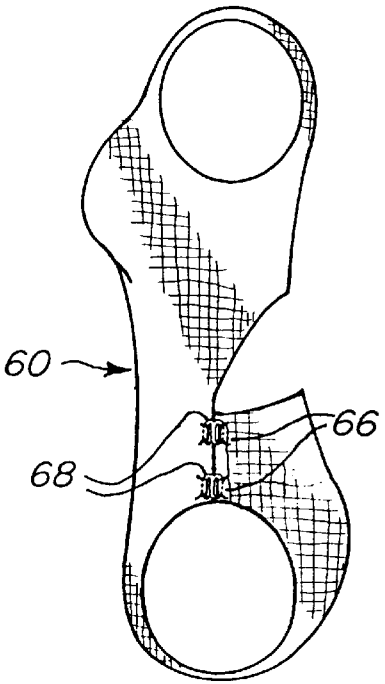
FIG. 6 is a side perspective view of a sixth embodiment, showing an alternative locking mechanism and pants portion.

FIGS. 6 and 7 show alternative embodiments of the invention to demonstrate further that the style of the suit may vary. For example, a waist band portion may extend at least part of the way around the garment to hide the fastening elements and a portion of the garment portion. Further, as shown in the torso portion 12 of FIG. 1*b*, some of a wearer's back may be left exposed between seat portion 14 and torso portion 12 for stylistic reasons. The top edge 15 of the seat portion 14 is cut straight across, and the bottom back edge 12d of the torso portion 12 is cut high so that when hooks 16 and loops 18 are fastened, a bikini bottom is formed. FIG. 6 shows an embodiment with a full, non-bikini seat, in which a pair of hooks 66 and loops 68 are provided at each hip of a suit 60 in order to provide more skin coverage at the hip and rear end. FIG. 7 shows an alternative torso arrangement. A suit 70 has a releasably attachable halter 73 and a bra hook 71 that forms a releasable top torso portion 77. The embodiment in FIG. 7 is particularly useful, in that the releasable top portion 77 easily allows the wearer to put on and remove the suit 70 under clothing.

Figure 12B:
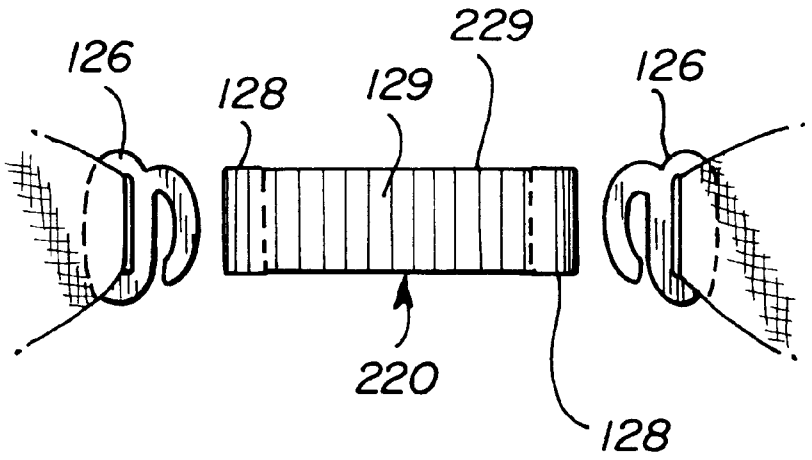
FIG. 12*b* is an enlarged view of the locking mechanism shown in FIG. 12*a;*
Figure 12A:
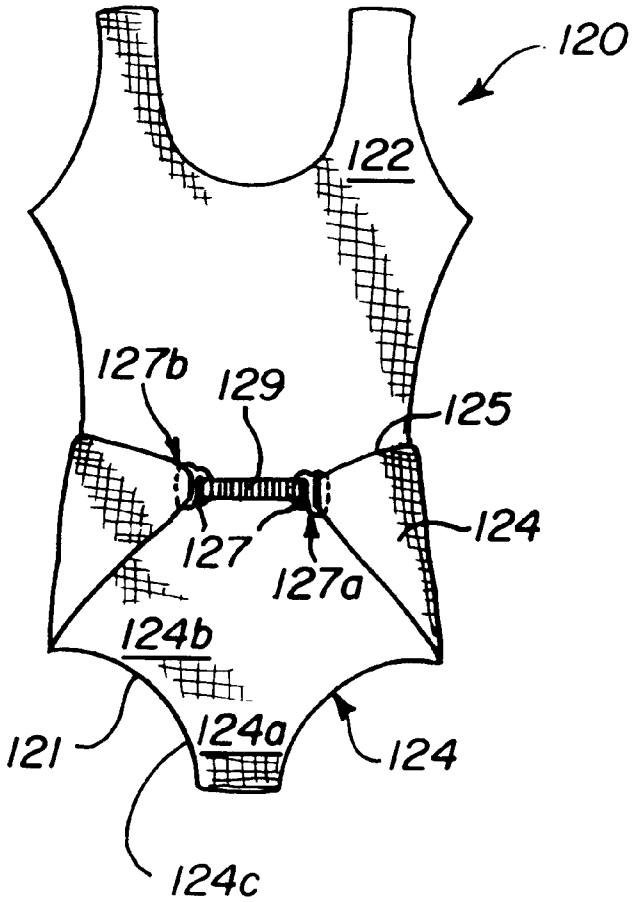
FIG. 12*a* is a front perspective view of a tenth embodiment, showing the suit as in use with another alternative locking mechanism.

FIGS. 12*a* and 12*b* show another embodiment of the invention, in which a garment or suit 120 is provided with an attachment system 220 comprising a connection element 229 to which a single set of fastening elements is attached when the suit 120 is assembled. The suit 120 has a torso portion 122 and a pants portion 121 that passes between the legs and connects to form the suit 120. The pants portion 121 has a front portion 124*a* that functions as a connecting portion 124*b*, connecting the pants portion 121 to the torso portion 121. The pants portion also has a seat portion 124 that functions as a selective attachment portion 124*c*. The seat portion 124 has first fastening elements or, hooks 126 on the left and right ends of the forward edge 125 of the seat portion 124, and a torso portion 122, with second fastening elements or loops 128 formed on the ends of a longitudinal strip 129 extending across the connecting portion near the connection of the torso portion 122 and the pants portion. The connection element may be attached to the pants portion 121; in this case it is sewn onto the exterior of the torso portion 122 at the waist. The strip 129 is elasticized is sized such that, when the hooks 126 are slipped into loops 128 to form a single set of fastening elements or pants fasteners 127, the circumference of the circle formed by the strip 129, fasteners 127, and forward edge 125 of the seat portion 124 is slightly smaller than the waist of the wearer. Thus, the strip 129 provides longitudinal tension between the pants fasteners 127 and toward each other when the pants fasteners 127 are attached. The strip 129 reduces the circumference of the garment, when the pants fasteners are attached, to be slightly smaller than the circumference of the wearer.

In use, when the suit 120 is formed on an wearer, the elasticized strip 129 slightly stretches to accommodate the difference in circumferential size. The stretch of the strip 129 provides a longitudinal tension between the fasteners 127, toward each other. The longitudinal tension increases horizontal tension across the back of the suit, on the forward edge 125. The increased horizontal tension holds the forward edge 125 more tightly to the body of the wearer, preventing any risk of exposure of the wearer's skin by slippage or gapping of the seat portion 124.

In addition, the strip 129 reinforces the attachment of the discrete pants fasteners 127 onto the suit 120. One consequence of using discrete fasteners on a garment is that they exert pulling pressure on the garment at the point of the discrete connection. Over time, or if the force suddenly becomes too great, tears in the material may occur at the pressure point. In the case of suit 120, the pulling would occur at discrete points 127*a* and 127*b*. Attachment of the strip 129 distributes the pulling that occurs at the discrete points 127*a* and 127*b* all the way across the front of the suit 120 and onto the fasteners 127 themselves. When hooks 126 are seated in loops 128, the distributed force forces the hooks 126 longitudinally apart from, and therefore more tightly into, the loops 128. Thus, the fasteners 127 are locked securely and are less apt to tear away from the material of the suit 120.

Finally, the strip 129 allows the fasteners 127 to be more easily fastened. The loops 128, being formed from ends of the strip 129, are easier to handle, to pull away from the suit 120 and hold onto while the connection with the hooks 126 is being made.

Figure 13:
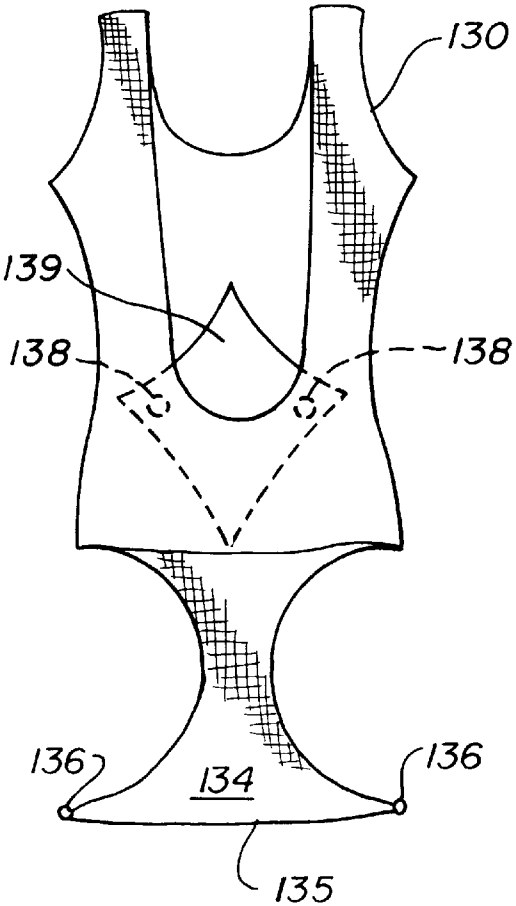
FIG. 13 is a back perspective view of an eleventh embodiment of the present invention, showing a disassembled suit.

The connection element may also be a reinforcing panel such as an elasticized stomach muscle control panel. FIG. 13 shows another embodiment of the invention, in which reinforcing panel 139 is sewn to the inside of the suit 130. Loops 138 are sewn to the outside of the suit 139, and hooks 136 are sewn to the left and right ends of the forward edge 135 of the seat portion 134. The panel 139 also provides the force distribution described above. The panel 139 may also be elasticized to provide stomach muscle control.

Figure 8:
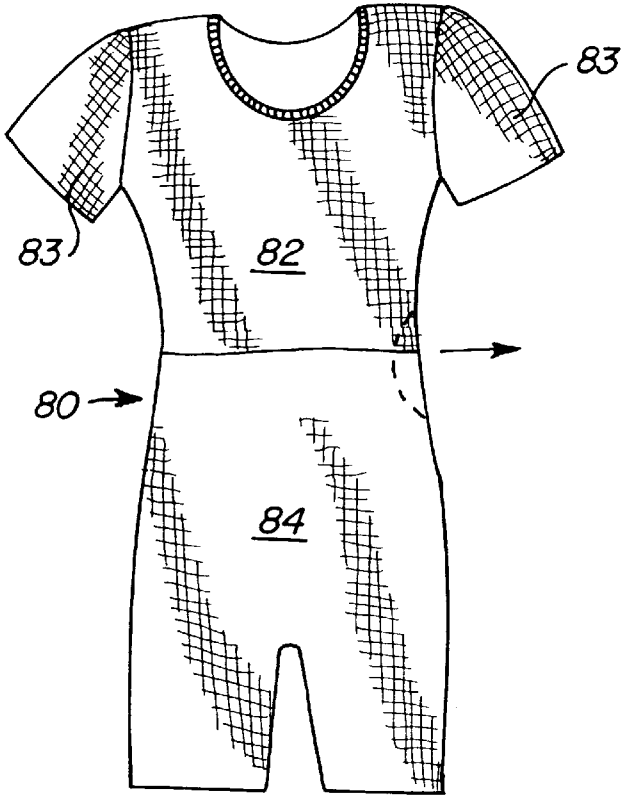
FIG. 8 is a front perspective view of an eighth embodiment, showing fully detachable torso and pants portions linked together to form a unitary garment.
Figure 9:
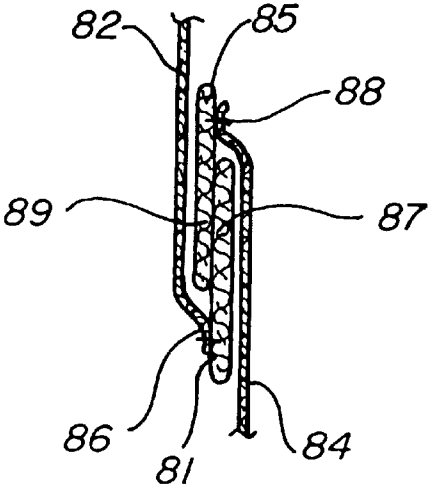
FIG. 9 is an enlarged view of the locking mechanism shown in FIG. 8.

FIG. 8 shows an alternative embodiment of the current invention, in which a torso portion 82, having sleeves 83, and a fully separate pants portion 84 are linked together at the waist to form a one piece suit 80. As seen in FIG. 9, which is shown out of scale for emphasis, the torso portion 82 has a torso under band 81 of ½ inch wide elastic sewn onto the bottom hem 86 of the torso portion 82 to form an upwardly and outwardly facing ridge 87 of approximately ⅛ inches height. Similarly, the pants portion 84 has a pants over band 85 of ¾ inch wide elastic sewn in a gathering manner onto the top hem 88 of the waist of the pants portion 84 to form a downwardly and inwardly facing ridge 89 of approximately ⅛ to ¼ inches height.

It is not necessary for the proper working of the current invention for the bands 81, 85 to be disposed about the waist of the garment 80. Wherever positioned, the pants over band 85 should have sufficient circumference to fit snugly about the wearer of the garment 80. While the torso under band 81 may be sewn on to provide some gathering of the material, in the current embodiment it is sewn straight, in a manner to achieve no material gathering. Preferably the circumference of the pants over band 85 is equal to or less than the circumference of the torso under band 81.

In use, when the torso portion 82 is tucked into the pants portion 84 and the pants over band 85 is positioned around the torso portion 82 slightly above the torso under band 81, the pants over band 85 slightly slides down and the torso under band 81 slightly slides up. The bands 81, 85 interlock, with the ridge 87 disposed between the ridge 89 and the pants portion 84 and the ridge 89 disposed between the ridge 87 and the torso portion 82, to form a unitary garment 80.

Figure 11:
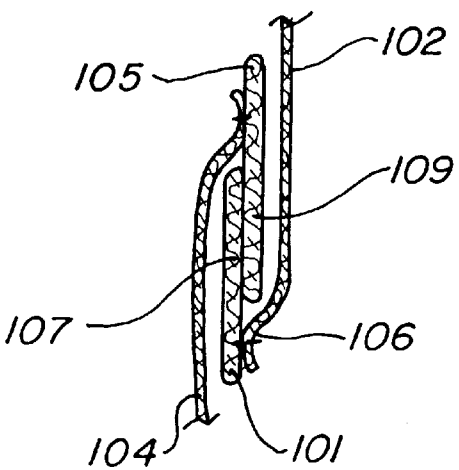
FIG. 11 is an enlarged view of the locking mechanism shown in FIG. 10.
Figure 10:
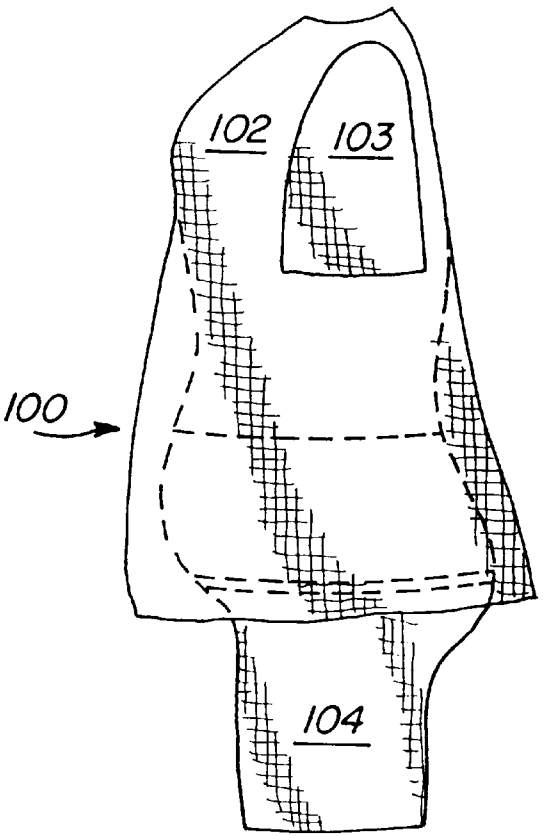
FIG. 10 is a side perspective view of an ninth embodiment, showing fully detachable torso and seat portions linked together to form a unitary garment, with the contours of a wearer's body and aspects of the pants portion, normally hidden by the torso portion, shown in dashed lines.

FIG. 10 shows another embodiment of the current invention, in which a torso portion 102, having sleeves 103, and a fully separate pants portion 104 are linked together to form a one piece maternity garment 100. Although it is not necessary for the proper working of the current invention in a non-maternity context, the torso portion 102 is blousy, that is, not form-fitting. As seen in FIG. 11, the torso portion 102 has a torso over band 101 of ½ inch wide elastic sewn in a gathering manner onto the bottom hem 106 of the torso portion 102 to form an upwardly and inwardly facing ridge 107 of approximately ⅛ inches height. Similarly, the pants portion 104 has a pants under band 105 of ¾ inch wide elastic sewn in a gathering manner onto the hips of the pants portion 104 to form a downwardly and outwardly facing ridge 109 of approximately ⅛ to ¼ inches height.

The torso over band 101 has sufficient circumference to fit snugly about the wearer of the garment 100. The pants portion 104 has a fastening mechanism, not shown, at the waist to hold the pants portion 104 up on the body of the wearer. While the pants under band 105 may be sewn on to provide some gathering of the material, in the current embodiment it is sewn straight, in a manner to achieve no material gathering. Preferably, the circumference of the torso over band 101 is equal to or less than the circumference of the pants under band 105.

In use, when the torso portion 102 is disposed over the pants portion 104 and the torso over band 101 is positioned around the pants portion 104 slightly below the pants under band 105, the pants under band 105 slightly slides down and the torso over band 101 slightly slides up. The bands 101, 105 interlock, with the ridge 107 disposed between the ridge 109 and the pants portion 104 and the ridge 109 disposed between the ridge 107 and the torso portion 102, to form a unitary garment 100.

The invention shown in the embodiment of FIG. 10, with the bands 101, 105 positioned to be disposed about the hips of the wearer, is particularly useful in maternity wear. The interlocking of the bands 101, 105 prevents the torso portion 104 from riding up on the hips of the wearer.

It is not necessary that the bands 81, 85 and 101, 105 be made of elastic; they could be made of any rigid or semi-rigid material that could be buckled or tied into place to provide the circumferential snugness necessary for the ridges 87, 89 and 107, 109 to interlock. Adjustable buckling or tying may be particularly useful in maternity clothes, where selective circumferential sizing through loosening of the bands may be useful as the pregnancy progresses and the hips widen. Elastic is the material of choice when stretching about the body is preferred to facilitate dressing and undressing. When the bands 81, 85 and 101, 105 are formed of elastic, it is preferred that the elastic have a no-roll composition or be made of a large proportion of polyester so that the ridges so formed have sufficient rigidity. Further, the bands, of whatever material, and ridges may be of different widths than the abovedescribed.

It is preferred that the suit 80 be made of a material with at least two-way stretch, to stretch both vertically and horizontally. As seen in FIG. 10, it is not necessary (and in the case of maternity wear, not preferred) for the material from which the suit 100 is made to have a two-way stretch. In order to provide a wearer of such a suit with full range of motion, it is only necessary to provide additional material length in the torso portions 82, 102. The bands 81, 85 and 101, 105 will still interlock, and the amount of material necessary for the torso portion in order to achieve full torso coverage is still decreased from that of a typical shirt/shorts combination.

When the suits 80, 100 are provided with short sleeves and short legs, as seen in FIGS. 8 and 10, they are particularly useful for the man, woman, or child for whom it would be preferable to provide sun protection without the use of sunscreen (which is expensive, must be applied carefully and frequently, and is of questionable health value). The suit 80 is preferable to the T-shirt and bathing trunk combination frequently sported at the beach, because the shirt portion 82 is more aerodynamic for exercise. Further, the suit 80 has less material on the torso portion, so it is easier to dry and more comfortable to wear.

The suit 80 is particularly useful for the bicyclist, wet suit user or unitard wearer, who will have the desired sleek, aerodynamic, non-chafing functionality of his or her conventional garment along with the dressing and undressing convenience provided by the current invention. The suits 80, 100 may have short, long, or no sleeves, and short, long, or no legs.

The invention described herein is useful in many applications in the garment field. As discussed before, it is suggested for use in swimming and exercise apparel. It also has applicability in any garment in which full body coverage and access to the crotch are both desired, such as wet suits, body suits, jumper suits, underwear suits, or children's apparel.

The materials with which garments embodying the current invention are made may be any materials suitable for the intended application. The materials may also be a print, have contrasting colors, have another busy pattern, or have a different texture or weave to facilitate concealing the inventive crotch area exposure mechanism. Further, it may be preferable to provide the exercise garment with a crotch piece made of cotton to maintain good air circulation during prolonged wear, in order to prevent yeast infection, which is a common problem resulting from extended wear of exercise apparel.

Having described preferred embodiments of the invention, it will now become apparent to those of skill in the art that other embodiments incorporating its concepts may be provided. It is felt therefore that this invention should not be limited to the disclosed embodiments but rather should be limited only by the spirit and scope of the appended claims.

What is claimed is:

1. A unitary garment for full or partial coverage of a torso, comprising:

a torso portion for providing at least some coverage of the front and back of a wearer, a pants portion having a front portion, a crotch portion for passing between the legs and connected to said front portion, a seat portion connected to said crotch portion, one of said seat portion and front portion functioning as a connecting portion connected to said torso portion, the other of said front portion and seat portion functioning as a selective attachment portion, said selective attachment portion having a crotch edge connected to said crotch portion, two sides extending therefrom, and an forward edge opposite said crotch and having left and right ends at the junction of said forward edge and said two sides, said pants portion also having at selected discrete locations visible to said wearer a single set of fastening elements that may be selectively attached to form discrete attachments on the exterior of said garment, a first of said elements in said set located at said left and right ends, a second of said elements in said set located near said connection of said torso portion and pants portion, so that said first and second fastening elements may be selectively attached and released from each other to cause said seat portion to be releasably and completely attached to said front portion, said attachments operable to selectively and completely assemble and disassemble said garment.

2. The unitary garment of claim 1, wherein said fastening elements are located at about the hips of said unitary garment.

3. The unitary garment of claim 1, wherein said fastening elements are positioned to attach said pants portion at about the waist of said wearer.

4. The unitary garment of claim 1, wherein said seat portion is connected to said torso portion.

5. The unitary garment of claim 1, wherein said front portion is connected to said torso portion.

6. The unitary garment of claim 1, wherein said torso portion has sufficient material at its bottom edge for disposition underneath said pants portion when said garment is assembled.

7. The unitary garment of claim 6, wherein said sufficient material comprises a shirt-tail.

8. The unitary garment of claim 1, wherein said torso portion is provided with a releasably attachable top torso portion, so that said unitary garment may be put on and removed under a wearer's clothing.

9. A unitary garment for full or partial coverage of a torso, comprising:

a torso portion for providing at least some coverage of the front and back of a wearer, and a pants portion having a front portion, a crotch portion for passing between the legs and connected to said front portion, a seat portion connected to said crotch portion, one of said seat portion and front portion functioning as a connecting portion connected to said torso portion, the other of said front portion and seat portion functioning as a selective attachment portion having at selected discrete locations a fastening system with a geometry that is essentially coplanar to said selective attachment portion and with first fastening elements that may be selectively attached to form discrete attachments on the exterior of said garment that, when operated, are essentially flat, said attachments operable to selectively assemble and disassemble said garment so that said garment may be fully put on or removed as an assembled or a disassembled garment, and further may be partially removed and put on, wherein said selective attachment portion is wrappable between the legs and disposed over said connecting portion, and wherein said fastening elements connect to themselves so that said selective attachment portion may be selectively attached to and released from itself over said connecting portion.

10. A unitary garment for full or partial coverage of a torso, comprising:

a torso portion for providing at least some coverage of the front and back of a wearer, and a pants portion having a front portion, a crotch portion for passing between the legs and connected to said front portion, a seat portion connected to said crotch portion, one of said seat portion and front portion functioning as a connecting portion connected to said torso portion, the other of said front portion and seat portion functioning as a selective attachment portion, said selective attachment portion having A crotch edge connected to said crotch portion, two sides extending therefrom, and an attachment edge extending across said sides opposite said crotch, to form two corners at the junctions of said attachment edge and said sides, said pants portion also having at each of said corners of said selective attachment portion at selected discrete locations visible to said wearer a single set of fastening elements with a geometry that is essentially coplanar to said selective attachment portion and with a first fastening element of said set that may be selectively attached to form discrete attachments on the exterior of said garment that, when operated, are essentially flat, said attachments operable to selectively and complete assemble and disassemble said garment.

11. The unitary garment of claim 10, wherein said connecting portion has a second fastening element of said set near said connection of said torso portion and pants portion, so that said first and second fastening elements may be selectively attached and released from each other to cause said seat portion to be releasably and completely attached to said front portion.

12. The unitary garment of claim 11, wherein said fastening elements are located at about the hips of said unitary garment.

13. The unitary garment of claim 11, further comprising a connection element attached to said pants portion and to which said set of fastening elements is attached when said garment is assembled.

14. The unitary garment of claim 13, wherein said connection element comprises an elasticized strip of material.

15. The unitary garment of claim 14, wherein said front portion functions as said connecting portion, and said seat portion functions as said selective attachment portion, said elasticized strip of material extending across said front portion, and said second fastening elements comprise loops at each end of said strip.

16. The unitary garment of claim 13, wherein said connection element comprises a panel.

17. The unitary garment of claim 16, wherein said panel comprises an elasticized stomach muscle control panel.

18. The unitary garment of claim 16, wherein said panel comprises a reinforcing panel.

19. The unitary garment of claim 10, wherein said fastening elements are positioned to attach said pants portion at about the waist of said wearer.

20. The unitary garment of claim 10, wherein said seat portion is connected to said torso portion.

21. The unitary garment of claim 10, wherein said front portion is connected to said torso portion.

22. The unitary garment of claim 10, wherein said torso portion has sufficient material at its bottom edge for disposition underneath said pants portion when said garment is assembled.

23. The unitary garment of claim 22, wherein said sufficient material comprises a shirt-tail.

24. The unitary garment of claim 10, wherein said torso portion is provided with a releasably attachable top torso portion, so that said unitary garment may be put on and removed under a wearer's clothing.

25. An attachment system for a unitary garment having a torso portion and a pants portion that passes between the legs and connects to form said garment, said pants portion with a seat portion and a front portion, said attachment system comprising pants fasteners that cause said seat portion to be releasably and completely attached to said front portion, said pants fasteners having seat fasteners connected to said seat portion and front fasteners connected to said front portion, so that said seat and front fasteners may be first selectively attached to form said pants fasteners, and then released to detach said pants portion, and means to provide longitudinal tension between said pants fasteners and toward each other when said seat fasteners are attached to said front fasteners.

26. An attachment system for a unitary garment having a torso portion, a pants portion that passes between the legs and connects to form said garment, said pants portion with a seat portion and a front portion, said attachment system comprising pants fasteners that cause said seat portion to be releasably and completely attached to said front portion, said pants fasteners having seat fasteners connected to said seat portion and front fasteners connected to said front portion, so that said seats and front fasteners may be first selectively attached to form said pants fasteners, and then released to detach said pants portion, and means to reduce the circumference of said garment, when said pants fasteners are attached, to be slightly smaller than the circumference of the wearer.

27. A unitary garment for full or partial coverage of a torso, comprising:

a torso portion for providing at least some coverage of the front and back of a wearer, and a pants portion having a front portion, a crotch portion for passing between the legs and connected to said front portion, a seat portion connected to said crotch portion, one of said seat portion and front portion functioning as a connecting portion connected to said torso portion, the other of said front portion and seat portion functioning as a selective attachment portion having a fastening system with a geometry that is essentially coplanar to said selective attachment portion and with first fastening elements that may be selectively attached to form attachments on the exterior of said garment that, when operated, are essentially flat, said attachments operable to selectively assemble and disassemble said garment, wherein said selective attachment portion is wrappable between the legs and disposed over said connecting portion, and wherein said fastening elements connect to themselves so that said selective attachment portion may be selectively attached to and released from itself over said connecting portion.

28. The unitary garment of claim 27, wherein said front portion comprises said connecting portion, and said seat portion comprises said selective attachment portion , said seat portion having a crotch edge connected to said crotch portion and two sides extending therefrom, said fastening elements located along at least a portion of said sides so that when said elements are attached, said sides form a panel.

29. The unitary garment of claim 28, wherein said panel comprises an elasticized stomach muscle control panel.

30. The unitary garment of claim 28, wherein said fastening system comprises a zipper.

31. The unitary garment of claim 28, wherein said panel comprises a reinforcing panel.

32. A unitary garment for full or partial coverage of a torso, comprising:

a torso portion for providing at least some coverage of the front and back of a wearer, a pants portion having a front portion, a crotch portion for passing between the legs and connected to said front portion, a seat portion connected to said crotch portion, one of said seat portion and front portion functioning as a connecting portion connected to said torso portion, the other of said front portion and seat portion functioning as a selective attachment portion, said selective attachment portion having a crotch edge connected to said crotch portion, two sides extending therefrom, and a forward edge opposite said crotch and having left and right corners at the junction of said forward edge and said two sides, said pants portion having a single set of fastening elements that may be selectively attached to form discrete attachments on said garment, said set located at selected discrete locations capable of being visible to said wearer during said attachment, said set having a first of said elements in said set located at said left and right corners, a second of said elements in said set located near said connection of said torso portion and pants portion, so that said first and second fastening elements may be selectively attached and released from each other to cause said seat portion to be releasably and completely attached to said front portion, fastening element hiding means for hiding said set of fastening elements and a portion of said garment when said set is attached, but for moving away from said elements of said set to render said elements capable of being visible during attachment and detachment.

33. The unitary garment of claim 32, wherein said fastening element hiding means comprises at least part of a waist band portion extending at least part of the way around the exterior of said garment.

34. The unitary garment of claim 32, wherein said fastening element hiding means comprises a skirt portion extending from said torso portion and disposed at least part of the way around the exterior of said garment.

35. The unitary garment of claim 34, wherein said skirt portion has sufficient length to constitute a minidress, said garment having said pants portion sewn onto the inside of said skirt portion, said skirt portion hiding the exterior of said pants portion, so that said pants portion is wrappable between the legs of a wearer and hidden under said a skirt portion.

* * * * *

UNITED STATES PATENT AND TRADEMARK OFFICE

CERTIFICATE OF CORRECTION

PATENT NO 6,035,439

DATED :14 March 2000

INVENTOR(S) May Y. Chin

It is certified that error appears in the above-identified patent and that said Letters Patent are hereby corrected as shown below:

Title page, item [75],

Under "Inventor:" delete

"22 Indian Springs Way, Wellesley, Mass. 02181", and replace with

–30 Goodman's Hill Road, Sudbury, Mass. 01776–.

Signed and Sealed this

Tenth Day of April, 2001

*Attest:*

Nicholas P. Godici

NICHOLAS P. GODICI

*Attesting Officer*

*Acting Director of the United States Patent and Trademark Office*